United States Patent [19]

Browning

[11] Patent Number: 4,458,961

[45] Date of Patent: Jul. 10, 1984

[54] COMPUTER TERMINAL WORK STATION

[76] Inventor: Jess Browning, 5615 Leeds St., Southgate, Calif. 90280

[21] Appl. No.: 287,317

[22] Filed: Jul. 27, 1981

[51] Int. Cl.[3] ..... A47B 53/00; A47B 21/00

[52] U.S. Cl. ..... 312/196; 312/107; 312/194; 312/198; 312/208

[58] Field of Search ..... 312/107, 111, 194, 195, 312/258, 198, 199, 203, 208, 196; 108/64, 92

[56] References Cited

U.S. PATENT DOCUMENTS

| | | | |
|---|---|---|---|
| 1,115,996 | 11/1914 | Wilson | 312/107 |
| 1,269,084 | 6/1918 | Hussey | 312/208 |
| 1,308,441 | 7/1919 | Myers | 312/198 |
| 1,398,237 | 11/1921 | Michaels | 312/208 |
| 1,485,549 | 3/1924 | Bieneman | 312/194 |
| 1,892,415 | 12/1932 | Ulrich | 312/107 |
| 2,506,844 | 5/1950 | Smith | 312/107 |
| 3,321,257 | 5/1967 | Carlson | 312/196 |
| 3,325,233 | 6/1967 | Oppenhuizen et al. | 312/198 |
| 3,346,311 | 10/1967 | Bears | 312/195 |
| 3,511,192 | 5/1970 | Noren | 108/64 |
| 3,529,878 | 9/1970 | Blowers | 312/107 |
| 3,653,734 | 4/1972 | Ungaro | 312/107 |
| 3,778,125 | 12/1973 | Gutmann, Jr. et al. | 312/208 |
| 3,862,785 | 1/1975 | Scheerhorn et al. | 312/196 |
| 3,893,533 | 7/1975 | Childs | 312/208 |
| 3,920,299 | 11/1975 | Propst et al. | 312/107 |
| 4,066,305 | 1/1978 | Gazarek | 312/195 |
| 4,080,022 | 3/1978 | Canfield et al. | 312/198 |
| 4,113,331 | 9/1978 | Derdzinski et al. | 312/198 |
| 4,316,082 | 2/1982 | Fritz | 312/208 |
| 4,323,291 | 4/1982 | Ball | 312/194 |
| 4,345,803 | 8/1982 | Heck | 312/194 |

FOREIGN PATENT DOCUMENTS

| | | | |
|---|---|---|---|
| 1161398 | 8/1958 | France | 312/107 |
| 1330542 | 5/1963 | France | 312/194 |
| 277601 | 9/1951 | Switzerland | 312/107 |
| 200399 | 7/1923 | United Kingdom | 312/111 |

*Primary Examiner*—Victor N. Sakran

[57] ABSTRACT

A computer terminal work station comprising a selected grouping of modular drawer, file and shelf units which are fastened together such as by sheet metal screws. The work station may house a variety of computer related equipment such as printers, cathode ray tube (CRT), a keyboard and other peripheral devices. The various modular elements are provided with a means for insuring accurate stacking. The modular element for supporting the CRT may be of a first height for supporting the CRT at a height comfortable for viewing by a standing computer operator, or of a second height for supporting the CRT at a height comfortable for viewing by a seated computer operator.

1 Claim, 3 Drawing Figures

COMPUTER TERMINAL WORK STATION

SUMMARY

A computer terminal work station is provided, comprising a selected grouping of modular drawer, file and shelf units which are fastened together such as by sheet metal screws. The work station may house a variety of computer related equipment such as printers, cathode ray tube (CRT), a keyboard and other peripheral devices. The various modular elements are provided with a means for insuring accurate stacking. The modular element for supporting the CRT may be of a first height for supporting the CRT at a height comfortable for viewing by a standing computer operator, or of a second height for supporting the CRT at a height comfortable for viewing by a seated computer operator.

DETAILED DESCRIPTION OF THE INVENTION

Figures 1, 2:
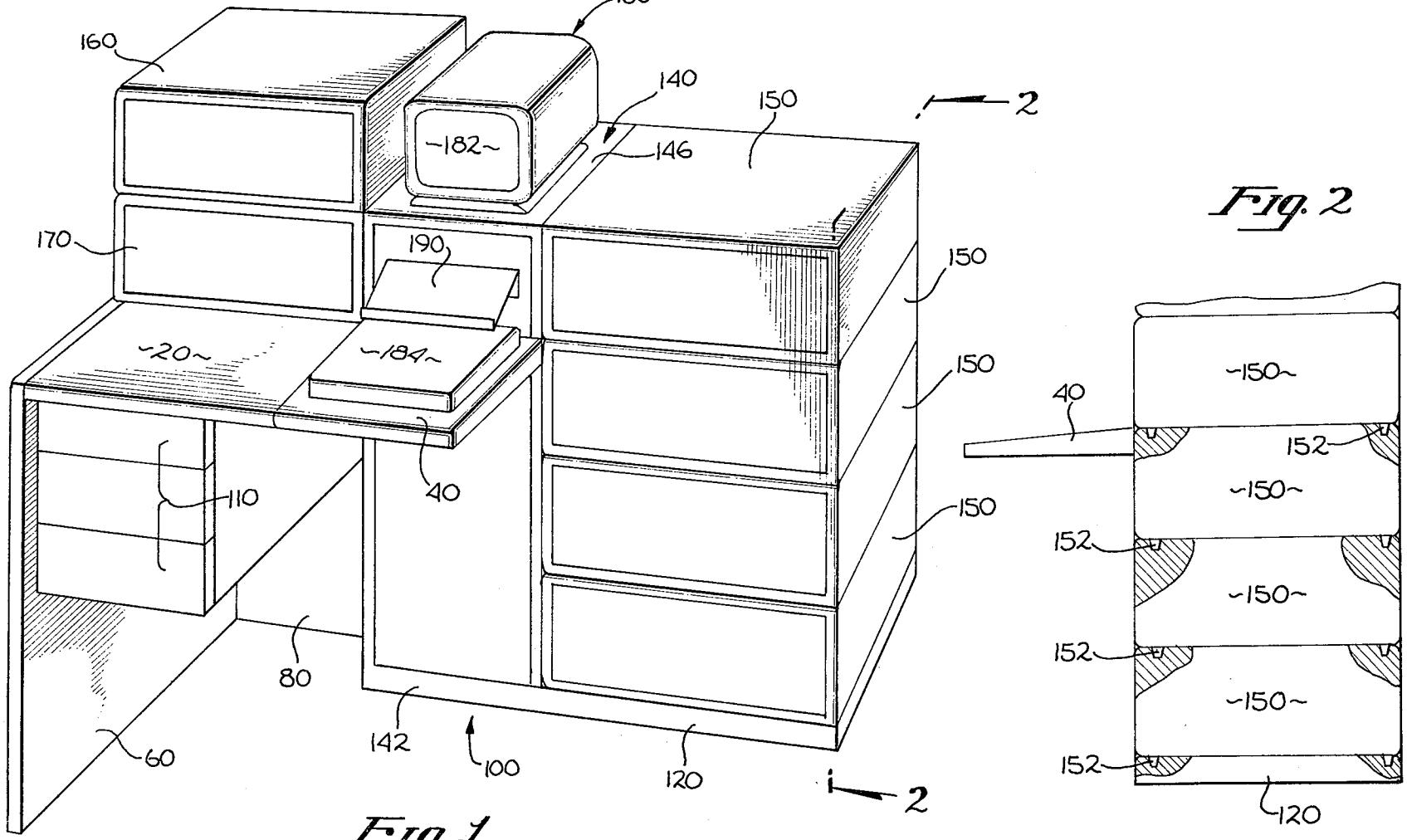
FIG. 1 is a perspective view of a work station designed for comfortable viewing of the CRT by a standing computer operator.
FIG. 2 is a partial cutaway of the end of the work station of FIG. 1 along the line 2—2.
Figure 3:
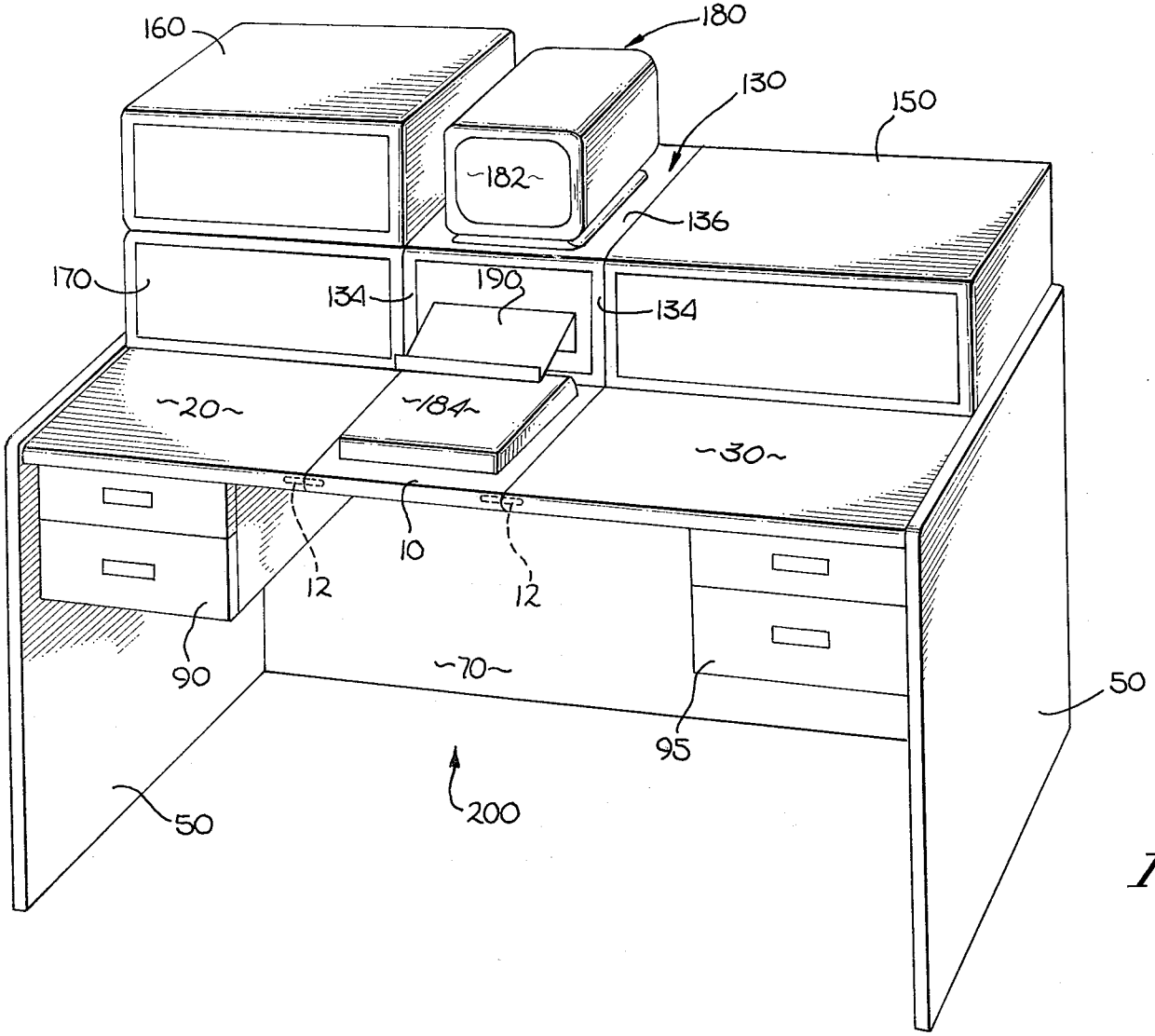
FIG. 3 is a perspective view of a work station designed for comfortable viewing of the CRT by a seated operator.

The computer terminal work stations 100 and 200 as shown in FIGS. 1 and 3 respectively, as well as work stations of differing configurations, may be constructed by the assembly of as few as two, or by assembly of an unlimited combination of basic modular units. In addition to providing hardware support these modules provide easy reference to software, computer print out and document storage by arranging the modules to meet individual requirements. The various modular units are esthetically clean in design and are human engineered to make the operator feel comfortable while working at the station. For example, the CRT is placed at an elevation approximately the eye level of another human. This allows longer periods of eye contact before fatigue due to unnatural head and eye positions in normal man-machine interfaces.

Work station 100 is designed for use by a standing operator. The work station 100 comprises as assembly of various modular units. An intermediate length work table 20 is fastened to a high end panel 60 and a high back panel 80. A three drawer unit 110 is secured in place beneath the work table 20 and against the high end panel 60. A work shelf 40 is mounted upon a high CRT rack 140, at a height level with the top of work table 20. Rack 140 has a base 142 two side walls 144 and a top panel 146 upon which is mounted the CRT 180 or other device. Rack 140 also may contain a 120 and/or a 240 volt spike suppressing power supply to provide one connection point for all electrical equipment. Against one of walls 144 may be stacked a plurality of shelf file units 150 resting on a shelf file base 120. On the other side of rack 140 and CRT 180 may be mounted a printer unit 160 and a peripheral unit 170 for housing other peripheral equipment.

As shown in FIG. 2, the shelf file units 150 may be provided on their top exterior surface with recesses for receiving the feet 152 of other units 150 stacked on top of them. The recesses and feet are only one illustration of a means for assuring accurate and secure stacking of units 150 on top of one another. Any other means, such as a groove and rail or virtually any recess and corresponding protuberance may be used to effect alignment of stacked units. The shelf file base 120, which rests on a floor is similarly provided with recess, but preferably does not have feet 152. The printer unit 160 and peripheral unit 170 may be similarly provided with recesses and protuberances (such as feet) for accurate and secure stacking.

The height of rack 140 is chosen such that the screen 182 of a CRT 180 placed upon the rack, would be at approximately eye-level of an operator. This placement of the CRT allows an operator to work at the station 100 with maximum comfort since he does not have to stretch and strain to view the screen 182. Also placed for ease of use are a computer keyboard 184 and text shelf 190 located below and in front of the CRT 180. The height of work shelf 40 and keyboard 184 allow the operators arms to hang naturally from the shoulder thus minimizing forearm fatigue.

Work station 200 is designed for maximum comfort of a seated operator, and comprises an assembly of a number of modular elements some of which are the same as the elements used to assemble work station 100. A short work table 10 is secured, such as by pins 12 or sheet metal screws or other suitable means, between an intermediate length work table 20 and a long work table 30. The free ends of table 20 and 30 are fastened between a pair of low end panels 50, and supported by securing to low back panel 70. Drawer units such as a standard file drawer unit 90 and a legal file drawer unit 95 may be mounted in place beneath the work tables 20 and 30 and against the low end panels 50. A low CRT rack 130, having a base 132 side panels 134 and a top 136, is mounted above the short work table 10. On one side of rack 130 and above work table 30 may be mounted one or more shelf file units 150. On the other side of the rack 130 may be mounted a printer unit 160 and a peripheral unit 170. The CRT 180 may be mounted on the top 136 of rack 130. Rack 130 also may contain a 120 and/or a 240 volt spike suppressing power supply to provide for one connection point for all electrical equipment. The height of rack 130 is such that the screen 182 of CRT 180 is placed at approximately eye level of a seated operator. A keyboard 184 and text shelf 190 may be conveniently located below the CRT 180 and in front of the operator.

The various modular units discussed, may be made of wood or of sheet metal and provided with rounded edges for a pleasing appearance and feel and for avoiding hazardous sharp edges. The units may be finished with a wood trim and/or various colored fused epoxy powder which has a pleasing appearance and texture and is a very durable coating.

Because of the modular construction, custom assembly of a work station to fit a particular space requirement or work requirement is greatly simplified. Any multiple of drawer units (i.e. standard file drawer units 90, legal file drawer units 95 or three drawer units 110) are first attached to a work table (one or more of tables 10, 20 or 30). The assembled drawers and tables are then attached by sheet metal screws to the low end panels 50 or high end panels 60. A corresponding low rack 130 or high rack 140 is selected and attached to the work tables. A corresponding low back panel 70 or high back panel 80 is attached to the structure and secured where needed to give desired support. A work shelf 40 is attached to the selected rack (130 or 140) and the keyboard 184 is placed on the work shelf. The computer, input device or computer terminal is then placed in position, e.g. within rack 140 for a standing work station 100, and a selected plurality of shelf file units 150, printer units 160 and peripheral units 170 are then stacked as desired. The CRT or other device is placed atop rack 130 or 140 and the printer and peripheral devices are installed within their respective modular units. The test shelf 190 is placed in position, a chair or stool may be added and the equipment is plugged in and turned on. The work station 100 or 200 is then ready for operation.

A set of modular work station units has thus been provided. By selection of a number of units from the set, various computer terminal work stations may be constructed. Two specific work stations have been shown in FIGS. 1 and 3. The station of FIG. 1 is designed for the comfort of a standing operator, while FIG. 3 shows a work station tailored to the comfort of a seated operator.

The keyboard 184 is placed at a height which allows the operator's arms to hang naturally from his shoulders thus minimizing forearm fatigue. The screen 182 is placed at the operator's eye level, thus the operator views the screen as though he was making eye contact with another person, in a naturally comfortable viewing direction. This placement of the screen prevents the back and neck strain and stress which results when an operator must lean forward to look at a low screen for extended periods of time.

The text shelf 190 for holding reference materials or a digitizing tablet, is located between the keyboard 184 and the CRT 180 to further reduce stress produced by an operator leaning away from a keyboard to read input data.

While the invention has been described with reference to FIGS. 1 through 3 and with particular reference to the modules and work stations shown therein, such description and Figures are for purposes of illustration only and should not be taken as defining the limits of my invention. Many changes in material and construction may be made by one of ordinary skill in the art without departing from the spirit and scope of the invention which is intended to be defined by the appended claims.

What is claimed is:

1. A work station constructed of a set of modular elements, comprising:

a central work table disposed at a height comfortable for a seated computer operator;

a back panel and a first and second end panel affixed to said central work table, said panels being attached to each other perpendicularly, and said end panels facing each other;

a short work table secured to one of said end panels, said back panel and said work table;

a plurality of file drawer units secured beneath said short work table;

a long work table planar with said central work table, said long work table being attached to the edge of said central work table, said second end panel and said back panel;

a plurality of second file drawer units secured beneath said long work table;

a box-shaped rack unit on top of said central table, said rack unit having a horizontal top surface for supporting a CRT;

a file shelf unit mounted upon said long work table;

a plurality of shelf units mounted upon said central work table for housing peripheral units to said computer; and a text shelf secured to said CRT supporting shelf.

* * * * *